US005820294A

United States Patent [19]

Baranowski

[11] Patent Number: 5,820,294

[45] Date of Patent: Oct. 13, 1998

[54] WHEELCHAIR ACCESS PATHWAY FOR SAND, BEACHES, LAWNS, GRASS AND FIELDS

[76] Inventor: Edwin M. Baranowski, 75 Marrus Dr., Gahanna, Ohio 43230

[21] Appl. No.: 839,697

[22] Filed: Apr. 15, 1997

Related U.S. Application Data

[63] Continuation of Ser. No. 555,440, Nov. 9, 1995, abandoned, which is a continuation-in-part of Ser. No. 157,719, Nov. 26, 1993, Pat. No. 5,476,339, which is a continuation-in-part of Ser. No. 826,838, Jan. 27, 1992, Pat. No. 5,319,818.

[51] Int. Cl.[6] ..... E01C 5/00; E01C 9/08; E01C 15/00

[52] U.S. Cl. ..... 404/36; 404/32; 404/73; 238/14; 428/131

[58] Field of Search ..... 404/17, 19, 35, 404/36, 7, 8, 41, 32, 73; 14/69.5; 47/1.01; 52/180, 177; 428/131, 44; 238/14

[56] References Cited

U.S. PATENT DOCUMENTS

| | | | |
|---|---|---|---|
| D. 232,895 | 9/1974 | Bell | 52/180 X |
| 964,601 | 7/1910 | Akerson . | |
| 1,410,055 | 3/1922 | Brian . | |
| 2,281,822 | 5/1942 | Bills et al. | 52/180 |
| 2,702,498 | 2/1955 | Arthur | 404/36 |
| 3,335,645 | 8/1967 | Eisenberg | 404/36 |
| 3,469,509 | 9/1969 | Hutchinson | 52/180 |
| 3,858,803 | 1/1975 | Gantert . | |
| 4,226,064 | 10/1980 | Kraayenhof | 52/180 |
| 4,265,399 | 5/1981 | Covington | 238/14 |
| 4,468,910 | 9/1984 | Morrison | 428/131 X |
| 4,478,901 | 10/1984 | Dickens et al. . | |
| 4,528,711 | 7/1985 | Packer | 14/69.5 |
| 4,584,221 | 4/1986 | Kung | 428/131 X |
| 4,596,731 | 6/1986 | Cudmore et al. | 404/36 X |
| 4,797,026 | 1/1989 | Webster | 404/35 X |
| 4,896,993 | 1/1990 | Bohnhoff | 404/35 X |
| 5,204,159 | 4/1993 | Tan | 404/19 X |
| 5,306,112 | 4/1994 | Kielinski . | |
| 5,439,171 | 8/1995 | Fruend . | |
| 5,457,837 | 10/1995 | Zuckerbrod | 14/69.5 |
| 5,476,339 | 12/1995 | Baranowski | 404/36 |
| 5,517,708 | 5/1996 | Baranowski . | |

*Primary Examiner*—James Lisehora

[57] ABSTRACT

A pathway for providing the transit of a wheelchair, including a person therein, over an uneven terrain surface that resists the rolling traction of a wheelchair, comprising a longitudinally extended flexible mat-like pathway configured such that the surface of the pathway is relatively porous with respect to the terrain surface, such as by providing therein a plurality of openings, and is capable of receiving thereon, at opposite side sections thereof, the front and side wheels of each side of a wheelchair. The pathways may be interconnected to pod-like landing sites at recreational locations.

13 Claims, 2 Drawing Sheets

WHEELCHAIR ACCESS PATHWAY FOR SAND, BEACHES, LAWNS, GRASS AND FIELDS

RELATED APPLICATIONS

This application is a continuation, of application Ser. No. 08/555,440, filed Nov. 9, 1995, now abandoned, which is a continuation-in-part of Ser. No. 08/157,719 fled on Nov. 26, 1993, now U.S. Pat. No. 5,465,339 in turn a continuation-in-part of Ser. No. 07/826,838, filed on Jan. 27, 1992, now U.S. Pat. No. 5,319,818.

FIELD OF THE INVENTION

This invention relates to accessibility means allowing wheelchair challenged persons improved access to recreational opportunities at beaches, lawns and fields having sand and grass surfaces that are otherwise barriers to wheelchairs.

BACKGROUND OF THE INVENTION

Wheelchair locomotion on sand, a beach, or grassy lawn or field is difficult. Sand and grass, normally considered pleasing and desirable to an able bodied person, present an obstruction to wheelchair transit and often immobilize a wheelchair user, preventing the wheelchair challenged person from participating in recreational and social activities conducted at sand and grass venues, such as for example, simple activities of sunbathing at a beach in Florida, going to a barbecue in an Arizona desert, or getting to a picnic table on the backyard lawn. Often, the wheelchair challenged person is an occasional visitor to such sites, and questions of appropriate access are forgotten or ignored. Alternatively, the installation of a permanent wheelchair access path over sand and grass is expensive and intrudes on the natural environment ambience. Prior art mechanisms for beach access include installations such as boardwalk extensions and concrete piers that support platforms extending to the beach, and/or into the ocean or body of water. Paved paths likewise allow passage and provide a hard smooth surf ace for wheelchairs. These mechanisms require the wheelchair challenged person to follow where the path leads, not necessarily where the person desires to go. At beaches, sand is a notorious barrier to wheelchair traction; the narrow wheels and the relationship of large diameter rear wheels and small diameter front wheels results in an inability to turn and maneuver the wheelchair in sand, Lawns and fields present a similar barrier; although the upper surface of a lawn may look smooth, the ground beneath is likely cratered and uneven on a scale that inhibits wheelchair locomotion . Sand and grass surfaces are uneven; sand grains and grass blades are relatively "slippery" to the rolling traction of a wheelchair. Prior art access paths are immobile and permanent installations, predetermining a fixed path. There is thus a need for a simple and conveniently deployed access pathway that is useful with wheelchairs that will provide a passage means from Point A to distant Point B over sand and grass recreational terrain surfaces.

It is an object of this invention to provide a means for the transit of a wheelchair (including a person in the wheelchair) over sandy beaches and uneven grassy surfaces such as lawns and fields. It is a further object to provide such means in an optionally temporarily deployable system (to be put in place on an as needed basis), so that the presenting environment is not significantly disturbed, and conventional maintenance, such as the periodic raking of a beach, or mowing of a lawn, is not appreciably interfered with. The pathway of the invention can be easily removed and replaced.

It is also an object of the invention to provide a retractable, and inexpensive, mechanism that allows the transit of wheelchairs at recreational venues located at beaches and lawns. The mechanism may be permanent, temporary, or temporarily and removably installed, to allow removal when not needed or when maintenance needs require. The mechanism may also be adapted to be adjustable in direction and/or length and provides a greater degree of freedom for the wheelchair user to predetermine a location at a distant desired site on the terrain involved to which the chair may be guided or taken.

These and other objects of the invention are more readily understood considered with the accompanying drawings:

DESCRIPTION OF THE PREFERRED EMBODIMENT

Figure 1:
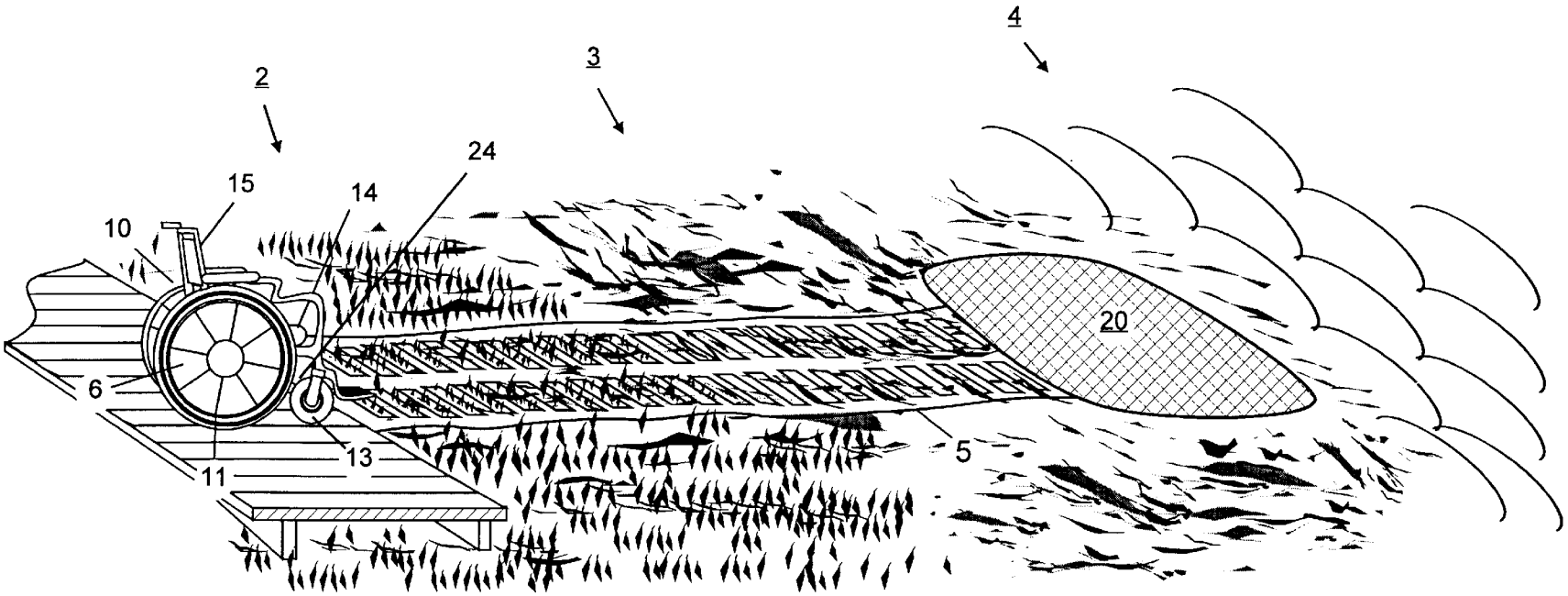
FIG. 1 shows in perspective a pathway of the invention extending from a walkway over a lawn and sandy beach to a distant destination pod.

The invention provides a pathway for the transit of a wheelchair (with a person therein) over a sand or grass barrier that otherwise inhibits or obstructs wheelchair access. With reference to FIG. 1, boardwalk 1 abuts a lawn 2 leading to sandy beach 3 at a lake, ocean or other body of water 4. The pathway 5 allows conventional rolling transport of wheelchair 6 over the grass and sand surfaces. For purposes of clarity, a person in the wheelchair is not shown, but is assumed to be present. Reference to a "wheelchair" in the context herein generally includes the chair and a person seated therein. For most wheelchair challenged persons, the wheelchair is a constant necessity, intrinsically associated with the person.

The wheelchair is a conventional chair having rear side wheels 10 and 11, front side wheels 12 (not shown in the view of FIG. 1) and 13, seat 14 and back 15.

The pathway 5 is longitudinally extended and is formed by a mat having a width sufficient to accommodate the wheelchair width. The mat allows a human assistant accompanying the wheelchair user to walk thereon. Preferably, an end section 24 of the pathway mat is anchored, such as to a boardwalk or other secure fixture, or to the ground, for example, by spikes or pegs.

Depending on size considerations required by wheelchair designs (typically wheel spacing), the path is about 30 to 36 inches (about 1 meter) wide, although width is not per se a critical dimension. For example, a double width pathway (about 2 yards or 2 meters wide), allows simultaneous bi-directional movement of two chairs. A wide path may also be more aesthetically pleasing or comfort generating.

Usually, in a recreational context, the distance from departure Point A to destination Point B when the pathway is installed will be measured in the order of tens of feet or multiple meters. The path may be temporarily deployed. Preferred materials for construction of the path include flexible fiber reinforced plastic or rubber type polymer mat material, having a high UV (ultraviolet ray) resistance (recognizing the outdoor use of the path), a flexible cross-linked polymer mat or other equivalent material. Depending on the availability of local materials, or beach or lawn aesthetic preference, a woven natural fiber such as hemp, or a flexible wood slat/grid construction, is also suitable. Likewise a laminate or composite of fiber and polymer comparable to conventional indoor/outdoor carpet is a suitable construction material. An appropriate thickness for a mat path would approximate that of a typical household "indoor/outdoor" carpet, about 0.2 to 0.4 inches (approximately 1 centimeter) or more, although thickness is a variable of construction material, desired durability, use environment and other factors. Metal media flexibly configured in accordance with the teachings herein, such as in a mesh or link type design may also be useful, but have a weight and flexibility disadvantage when compared with polymer, composite or fiber materials.

Figure 2:
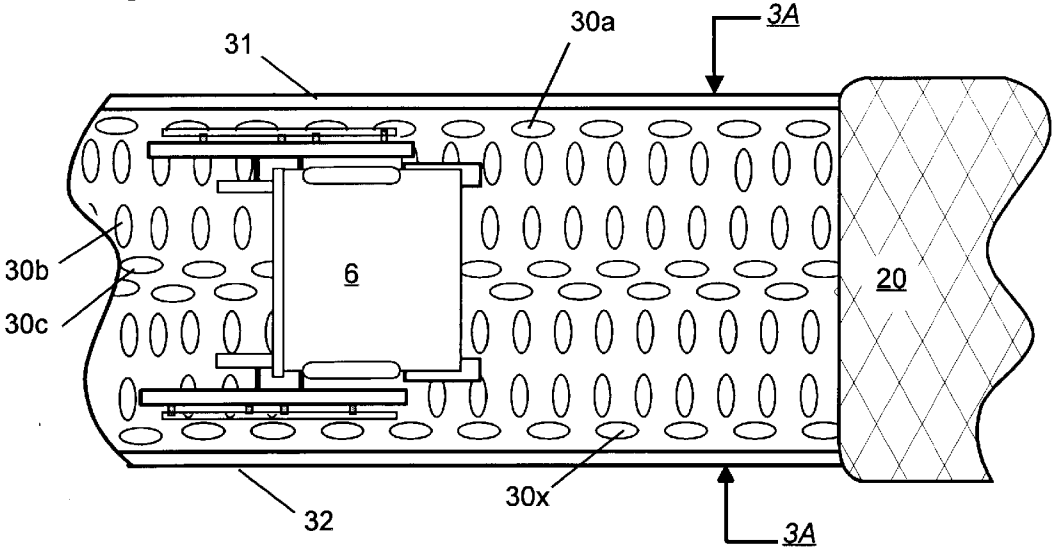
FIG. 2 is a top view of a wheelchair on a pathway of the invention.

As shown in greater detail in FIG. 2, the path includes a pattern of openings, 30*a*, 30*b*, 30*c*, 30*x*, etc., formed therein. Optional, upward extending "curb" sections, 31 and 32, at the side edges of the paths (approximately 0.55 to 1.0 inches (1.5 to 3 centimeters) or more above the path surface) provide a degree of guidance and/or assurance that the wheelchair does not deviate from the pathway. One or two such curbs, on one or both pathways may be provided.

Figure 3:
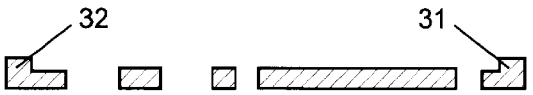
FIG. 3 is a cross-section of a pathway through section 3A→←3A of FIG. 2.
Figure 4A:
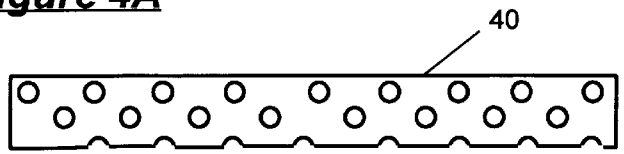
FIGS. 4A and 4B are, respectively, a top view and cross-section of an alternatively configured pathway combining a pattern of small holes such as circles and downward projecting conical ribs in a mat useful in the invention.
Figure 4B:
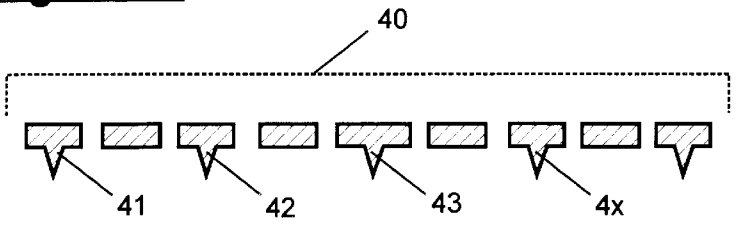

The openings in the paths allow the presenting sand or grass terrain surface to penetrate up from the beach or lawn and anchor the path thereon. After a brief time and/or use, the path will "sink" slightly into the surface and become anchored. A benefit of this occurrence is that, as a result, the presence of the pathway will not greatly disturb the aesthetics of the environment. Similarly, grass from a lawn will migrate through the openings and cause anchoring. Usually, an equilibrium of the mat with the weight of the wheelchair on the sand or grass is achieved. In this regard, the path is "porous" with respect to the presenting sand or grass terrain. And the migration of the grass or sand through the openings blends the pathway visually with the environment. As used herein, "porous" refers to a holed material having openings that allow the surface material underneath to migrate upwardly through the openings. The openings also allow the pathway mat material to flexibly conform to the unevenness inherent in lawn and beach surfaces. In a path having a cross-section as characterized in FIGS. 3 and 4, the terrain material migrates upward toward the bottom surface of the mat to anchor the mat on the terrain surface. In FIGS. 4A and 4B, a section of a mat 40 (across the width thereof) is shown having downward projecting nibs 41, 42, 43, etc., extending from the bottom surface of the mat. The nibs may be conical, cylindrically-sectioned, cubical, or formed in any other three-dimensional shape, such that they have the characteristic with respect to upward migration of the terrain surface described above. A combination of openings and nibs is appropriate. Because a path configured according to FIGS. 4A and 4B requires a greater volume or mass of material, it is likely to have a greater weight and higher cost, and is consequently less preferred.

The openings may be circular or curvilinear cutouts, a square, triangle, polygon or other multisided grid or random pattern. Although not critical, the dimension and relationship of opening area may vary with terrain, wheelchair weight, wheel size and other factors. The openings should typically open approximately 20%–80% of the approximately rectangular surface area otherwise covered by the path sections on the terrain surface; openings of about 1 to 3 square inches (about 5 to 45 square centimeters) appear appropriate. Because the pathway is either regularly removed when maintenance of the beach or lawn surface is required, temporarily deployed when needed, or periodically replaced as a matter of maintenance, the pathway does not become "buried" in the terrain.

Figure 5:
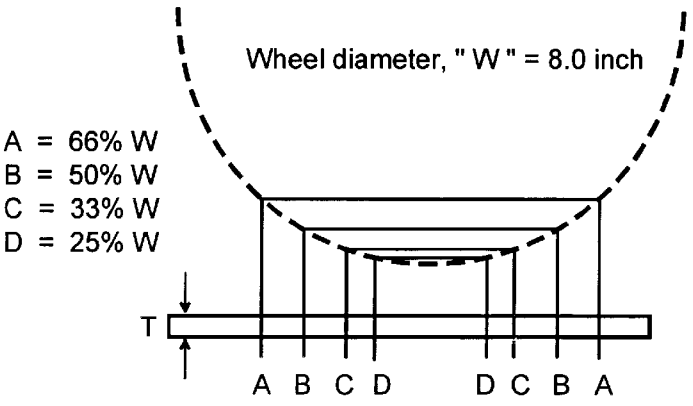
FIG. 5 is a relationship chart of the size of openings in the pathway with regard to the relative size of an opening in comparison with the diameter of the small wheels of a wheelchair.

In the view shown in FIG. 1, the grass and/or beach surface, is shown to protrude or extend upward through the path "openings." The rationale of operation of the pathway mechanism is that a wheelchair supporting path is provided, which, because it is porous as defined herein, settles firmly on the presenting, uneven surface. In contrast, if, for example, a solid carpet or mat were placed over sand or grass, the solid covering, about a yard or meter wide extending 10, 20, 30 or more feet (3 to 10 or more meters), because of the uneven nature of the terrain, would not anchor itself and would not conform to the uneven surface of the lawn or beach. In addition, the appearance of a solid surface would also disturb the natural appearance and environment defeating the visually pleasing impression of a beach or lawn. In contrast, the paths herein are porous; and the openings that allow the porosity also create a pliability in the mat so that it conforms readily to the unevenness inherent in a beach or lawn surface. The openings further reduce the weight of the pathway, enabling it to be easily rolled up and removed. A pathway formed from a solid, rigid bridge material similarly contrasts with the principles of operation of the invention. The relationship of the opening size of the holes in the pattern in the pathway to the diameter of the small wheels of the wheelchair is instinctively determined first in that the openings should not be larger than the wheel diameter dimension traversing the openings. FIG. 5 shows a chart relating selected opening sizes "A", "B", "C" and "D" to wheel diameter "W." In most wheelchairs the diameter of the small wheels, usually the front wheels, is about 6.0 to 8.0 inches (2.5 to 3.5 cm.) "T" indicates pathway thickness. A useful relationship of opening size to wheel size seems to be about ¼ to ⅓ or 5/12 (denominator= wheel diameter) with openings in the range of larger than about ⅓ to ½ appearing to exceed a useful limit. Sand grain size and grass coarseness are also factors for opening size within these limits. Another factor in opening configuration is that the openings should not be so wide such that the wheels become lodged therein. Hence, diameter and length and width of the openings in the pathway are related to wheel diameter in the determination of the opening size and a pattern for the openings. Openings approaching circles and squares with diameters and sides less than about ⅓ to ¼ wheel diameter are satisfactory. Elongated rectangular shaped openings oriented transverse to the length of the pathway with a similar width, less than about ⅓ to ¼ wheel diameter, are also satisfactory as the pathway shown in FIG. 1 is so configured.

Depending on material selection, a pathway may be formed of a sufficiently lightweight material to provide a portable mechanism to be carried with the wheelchair challenged person (or an assistant) and rolled out on site. At an attended beach, however, such as at a hotel or park, the pathway could be anchored to a boardwalk (i.e., a preexisting accessibility path) or elsewhere, and deployed by lifeguards or beach or park attendants when needed. A ground fault protected, electrically (or otherwise) powered system may also be adapted for unrolling and rolling up the pathway. To a degree, because of its flexible and porous, pliable nature and its intrinsic weight, the pathway may also be considered self-anchoring.

The pathways may be directed to, equipped with, or joined to "pod" like sections at an end thereof (e.g., sections about 30×30 inches (75×75 centimeters) square or rounded or other shaped extended surface areas capable of supporting a wheelchair and allowing limited movement thereon) to provide a positional destination and/or to allow turning movement of the wheelchair thereon, and from these sections, other pathway sections in turn may lead to other pods. Such a pod is shown in FIGS. 1 and 2 at 20. Similarly, pods for wheelchair locations may be fixed, or may be independently positioned on the terrain to provide a destination location for the wheelchair, and interconnected with other access pathways.

The size and shape of a pod is optional, however, a pod about 42–48 inches (1.0–1.2 meter) square or in diameter is a sufficiently comfortable size for a standard size adult wheelchair. At a beach, this will allow turning to different directions to avoid sunburn. A roomy "island" pod, for example, may likely be six feet (two meters) or more square to allow positional movement of the wheelchair at the destination pod and permit other persons to be seated thereon. A pod size guideline is the area defined by conventional beach umbrellas or the seating area at a side of a picnic table. The deployment of location pods and pathways leading to the pods, at an attended public or commercial beach, for example, is an activity no more difficult for beach attendants than is a conventional placement and set up of a beach lounge chair.

Depending on the material of construction and design preference, the pathway and/or pod may be colored in whole or in part, for example, by safety yellow, to highlight its presence, or camouflaged in an appropriate pattern to blend in with the natural environment.

The dimensions and proportions herein and the materials of fabrication depend on design considerations of durability, weight, public or institutional use considerations, aesthetics, ambient temperature, and other factors, provided however, that good design criteria for the wheelchair application, given the foregoing disclosure, are satisfied.

What is claimed is:

1. A pathway for enabling the rolling passage of a wheelchair including a person therein along a pedestrian route from Point A to Point B over one of a sand or grass recreational surface terrain that is otherwise resistant to the rolling traction of a wheelchair, the wheelchair including a plurality of wheels, the pathway comprising a mat having an area defining the pathway and being intrinsically formed from a three dimensionally flexible material selected from the group of: flexible metal, wood, plastic, rubber and polymer materials; fiber reinforced plastic and rubber type polymers, flexible T cross-linked polymers; UV resistant polymers; woven natural fibers; flexible wood grid materials; and a metal media conformable to the sand or grass surface, the mat being longitudinally extended over and pliably conforming to the terrain surface along the route, said mat having a width at least as wide as the separation distance of the wheels of the wheelchair such that the width is sufficient to maintain the wheelchair thereon, the mat having a thickness with a cross-sectional construction such that the mat includes a plurality of openings therethrough that allow the mat to be porous with respect to the one of sand or grass and to allow the respective one of the sand or grass to migrate upward from the terrain surface through the mat to anchor the mat on the terrain and to be pliable such that the mat conforms to the terrain surface and supports the wheelchair thereon, the openings included in the mat having an aggregate area with respect to area of the mat defining the pathway (a) as the area of the mat defining the pathway is measured by the length of the mat times its width and (b) as the area of the openings is defined as the sum of the areas of the openings in the mat within the area of the mat, is from approximately 20% to approximately 80% of the area of the mat, the openings further having, in the section of the mat passed over by the wheelchair, a longitudinal length not more than about ½ of the diameter of the smallest wheel of the wheelchair with which the mat is used the pathway being initially in a rolled unit having an overall length at least sufficient to extend from Point A to Point B. the pathway in rolled form being unrolled along the route on an as needed basis when required for the transit of a person in a wheelchair.

2. The pathway of claim 1 including an upwardly extending side curb extending from a longitudinal side edge of the mat that defines the width thereof, the curb extending along a segment of the length thereof.

3. The pathway of claim 1 in which an end of the roll is secured to a wheelchair accessible path.

4. The pathway of claim 1 in combination with a destination pod at Point B to which the route connects from an otherwise wheelchair passable path at Point A, the pod being at a location on the terrain distant from Point A, the destination pod at Point B comprising an extended wheelchair tractionable surface on the terrain sufficiently large to allow turning movement of a wheelchair within the surface area of the pod.

5. The pathway of claim 1 in which the pathway is a mat including on the lower surface thereof facing toward the sand or grass terrain, a plurality of nibs intrinsically formed in the lower terrain facing surface of the mat from the material of the mat, the nibs comprising solid shapes projecting downward toward the terrain surface from the lower surface of the mat and with respect to which, the sand or grass of the terrain surface migrates upwardly to the lower surface of the mat material and through the openings in the mat.

6. The pathway of claim 5 in which the nibs are one or more than one of a conical, cylindrically-sectioned, cubical or other three dimensional shape.

7. The pathway of claim 1 in which the mat includes a plurality of differently sized and differently oriented openings in a pattern in the surface thereof.

8. The pathway of claim 1 in which the length of the openings along the longitudinal axis of the mat is less than about ¼ of the diameter of the smallest,wheel of a wheelchair with which the mat is used.

9. The pathway of claim 1 in which the length of the openings along the longitudinal axis of the mat is less than about ⅓ of the diameter of the smallest wheel of a wheelchair with which the mat is used.

10. The pathway of claim 1 in which the length of the openings along the longitudinal axis of the mat is less than about 5/12 of the diameter of the smallest wheel of a wheelchair with which the mat is used.

11. The pathway of claim 1 in which the length of the openings along the longitudinal axis of the mat is from about ¼ to about ⅓ of the diameter of the smallest wheel of a wheelchair with which the mat is used.

12. The pathway of claim 1 in which the thickness of the mat is about 0.2 to about 0.4 inches.

13. The pathway of claim 1 in which the thickness of the mat is about 1.0 centimeter.

* * * * *